US009404288B2

(12) United States Patent
Curtis et al.

(10) Patent No.: US 9,404,288 B2
(45) Date of Patent: Aug. 2, 2016

(54) WINDOW OPENING CONTROL DEVICE FOR HORIZONTAL AND VERTICAL SLIDING WINDOWS

(71) Applicant: Marvin Lumber and Cedar Company, Warroad, MN (US)

(72) Inventors: Daniel Jon Curtis, Warroad, MN (US); John Joseph Sopkowiak, Williams, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 0 days.

(21) Appl. No.: 14/669,985

(22) Filed: Mar. 26, 2015

(65) Prior Publication Data

US 2015/0275556 A1 Oct. 1, 2015

Related U.S. Application Data

(60) Provisional application No. 61/967,837, filed on Mar. 27, 2014.

(51) Int. Cl.
*E05B 65/08* (2006.01)
*E06B 3/44* (2006.01)
(Continued)

(52) U.S. Cl.
CPC ..... *E05B 65/0835* (2013.01); *E05B 65/0014* (2013.01); *E05C 17/50* (2013.01);
(Continued)

(58) Field of Classification Search
CPC ..... E05B 65/0835; E05B 65/0841; E06B 3/4415; E05C 17/60
USPC ..... 49/449, 176, 181, 183–185; 292/338, 292/339, DIG. 20, DIG. 47, 230
See application file for complete search history.

(56) References Cited

U.S. PATENT DOCUMENTS 37,625 A 2/1863 Hyde
198,553 A 12/1877 Auer
(Continued)

FOREIGN PATENT DOCUMENTS

FR 2572145 A1 4/1986
GB 2410058 A 7/2005
(Continued)

OTHER PUBLICATIONS

"U.S. Appl. No. 13/006,873, Non Final Office Action mailed Nov. 9, 2012", 6 pgs.
"U.S. Appl. No. 13/006,873, Notice of Allowance mailed Apr. 24, 2013", 6 pgs.
(Continued)

*Primary Examiner* — Katherine Mitchell
*Assistant Examiner* — Marcus Menezes
(74) *Attorney, Agent, or Firm* — Schwegman Lundberg & Woessner, P.A.

(57) ABSTRACT

A sash limiter assembly includes a limiter housing configured for installation in a sash or a window frame of a window. A sash stop is movably coupled with the limiter housing, and the sash stop is movable between engaging and retained positions. A reset is movably coupled with the limiter housing, and the reset is movable into a resetting position. The sash limiter assembly is configured for positioning between a sash limiting configuration and a resetting configuration. In the sash limiting configuration the sash stop is in the engaging position and positioned in a translation path of the sash. In the resetting configuration the sash stop is held in the retained position by the reset in the resetting position. In the retained position the sash stop is out of alignment with the translation path, and in the resetting position the reset is positioned within the translation path.

27 Claims, 15 Drawing Sheets

(51) Int. Cl.

| | |
|---|---|
| ***E05C 17/60*** | (2006.01) |
| ***E05B 65/00*** | (2006.01) |
| ***E05C 17/50*** | (2006.01) |
| *E06B 5/11* | (2006.01) |
| *E05C 7/00* | (2006.01) |

(52) U.S. Cl.

CPC ..... *E05C 17/60* (2013.01); *E06B 3/4415* (2013.01); *E05C 2007/007* (2013.01); *E06B 3/4407* (2013.01); *E06B 5/113* (2013.01)

(56) References Cited

U.S. PATENT DOCUMENTS

| | | | | |
|---|---|---|---|---|
| 226,033 | A * | 3/1880 | Burns, Jr. | E05B 63/20 292/336 |
| 278,802 | A | 6/1883 | Kubler et al. | |
| 523,736 | A | 7/1894 | Cazin | |
| 551,181 | A | 12/1895 | Dillon | |
| 756,453 | A | 4/1904 | Arens et al. | |
| 804,994 | A * | 11/1905 | Andrews | E05B 65/0852 292/210 |
| 976,777 | A | 11/1910 | Brown | |
| 1,016,422 | A | 2/1912 | Lauritsen | |
| 1,069,079 | A | 7/1913 | Voight | |
| 1,261,274 | A | 4/1918 | Newsam | |
| 1,322,677 | A * | 11/1919 | Ditlefsen | E05B 65/0852 292/210 |
| 1,350,698 | A | 8/1920 | Boedtcher | |
| 1,724,637 | A | 8/1929 | Bergstrom | |
| 1,946,833 | A * | 2/1934 | Brown | E05F 11/00 292/219 |
| 2,062,020 | A | 11/1936 | Engel | |
| 2,158,260 | A * | 5/1939 | Stillman | E05F 11/00 292/336 |
| 3,083,045 | A | 3/1963 | Linderoth | |
| 3,151,901 | A | 10/1964 | Aldgren | |
| 3,897,966 | A | 8/1975 | Draughon | |
| 3,910,614 | A | 10/1975 | Coe | |
| 3,912,311 | A | 10/1975 | Carvell et al. | |
| 4,027,907 | A | 6/1977 | Crepinek | |
| 4,095,827 | A | 6/1978 | Stavenau | |
| 4,248,461 | A | 2/1981 | Stevens | |
| 4,263,747 | A | 4/1981 | Coltrin et al. | |
| 4,379,576 | A | 4/1983 | Blough et al. | |
| 4,383,666 | A | 5/1983 | Allerding et al. | |
| 4,577,896 | A | 3/1986 | Crepinsek | |
| 4,580,819 | A | 4/1986 | Crepinsek | |
| 4,580,820 | A | 4/1986 | Baber | |
| 4,635,976 | A | 1/1987 | Sigler | |
| 4,639,024 | A | 1/1987 | Crepinsek | |
| 4,897,961 | A | 2/1990 | Shine | |
| 5,248,174 | A * | 9/1993 | Matz | E05B 65/0852 292/338 |
| 5,452,596 | A | 9/1995 | Yamada | |
| 5,457,971 | A | 10/1995 | Yamada | |
| 5,536,052 | A | 7/1996 | Maier | |
| 5,575,116 | A | 11/1996 | Carlson et al. | |
| 5,647,233 | A | 7/1997 | Chung | |
| 5,669,256 | A | 9/1997 | Chung | |
| 5,806,900 | A | 9/1998 | Bratcher et al. | |
| 6,000,735 | A | 12/1999 | Jourdenais | |
| 6,021,603 | A | 2/2000 | Prete et al. | |
| 6,364,375 | B1 | 4/2002 | Szapucki et al. | |
| 6,382,689 | B1 | 5/2002 | Brown | |
| 6,572,158 | B2 * | 6/2003 | Szapucki | E05B 65/0852 292/221 |
| 6,634,681 | B1 | 10/2003 | Redden | |
| 6,684,454 | B2 | 2/2004 | Ehrenreich | |
| 7,063,361 | B1 | 6/2006 | Lawrence | |
| 7,093,392 | B2 | 8/2006 | Derham et al. | |
| 7,296,831 | B2 | 11/2007 | Generowicz et al. | |
| 7,441,812 | B2 | 10/2008 | Welsh et al. | |
| D581,247 | S | 11/2008 | Durrant | |
| 7,494,164 | B1 * | 2/2009 | Garries | E05B 65/0835 292/332 |
| 7,588,271 | B1 | 9/2009 | Lawrence | |
| 7,600,796 | B2 | 10/2009 | Liang et al. | |
| 8,075,038 | B2 | 12/2011 | Zielinsky | |
| 8,096,593 | B2 | 1/2012 | Gibbons | |
| 8,360,484 | B2 * | 1/2013 | Liang | E05B 65/0847 292/220 |
| 8,490,330 | B2 | 7/2013 | Lund et al. | |
| 8,776,440 | B2 * | 7/2014 | Sopkowiak | E05B 65/0835 292/338 |
| 8,888,146 | B2 | 11/2014 | Taylor et al. | |
| 8,991,228 | B2 | 3/2015 | Yang | |
| 2003/0122387 | A1 | 7/2003 | Ward | |
| 2003/0167694 | A1 | 9/2003 | Liang | |
| 2007/0182168 | A1 | 8/2007 | Allen | |
| 2007/0222233 | A1 | 9/2007 | Liang et al. | |
| 2010/0019513 | A1 | 1/2010 | Generowicz et al. | |
| 2010/0072763 | A1 | 3/2010 | Allen | |
| 2011/0113695 | A1 * | 5/2011 | Derham | E05C 3/12 49/445 |
| 2011/0173895 | A1 | 7/2011 | Lund et al. | |
| 2011/0203184 | A1 | 8/2011 | Nguyen et al. | |
| 2012/0144752 | A1 * | 6/2012 | Piltingsrud | E05C 17/46 49/450 |
| 2012/0167475 | A1 | 7/2012 | Sopkowiak et al. | |
| 2015/0159429 | A1 | 6/2015 | Lund | |

FOREIGN PATENT DOCUMENTS

| | | | |
|---|---|---|---|
| GB | 2461079 | A | 12/2009 |
| GB | 2461107 | A | 12/2009 |
| GB | 2461108 | A | 12/2009 |
| WO | WO-99/46464 | A2 | 9/1999 |
| WO | WO-2009/072839 | A1 | 6/2009 |
| WO | WO-2009/153562 | A1 | 12/2009 |
| WO | WO-2009/153564 | A1 | 12/2009 |

OTHER PUBLICATIONS

"U.S. Appl. No. 13/006,873, Response filed Feb. 8, 2013 to Non Final Office Action mailed Nov. 9, 2012", 11 pgs.

"U.S. Appl. No. 13/006,873, Response filed Oct. 5, 2012 to Restriction Requirement mailed Sep. 20, 2012", 9 pgs.

"U.S. Appl. No. 13/006,873, Restriction Requirement mailed Sep. 20, 2012", 5 pgs.

"U.S. Appl. No. 13/328,776 , Response filed Feb. 13, 2014 to Final Office Action mailed Nov. 22, 2013", 15 pgs.

"U.S. Appl. No. 13/328,776, Examiner Interview Summary mailed Jan. 30, 2014", 3 pgs.

"U.S. Appl. No. 13/328,776, Final Office Action mailed Nov. 22, 2013", 14 pgs.

"U.S. Appl. No. 13/328,776, Non Final Office Action mailed Jun. 21, 2013", 12 pgs.

"U.S. Appl. No. 13/328,776, Notice of Allowance mailed Mar. 7, 2014", 11 pgs.

"U.S. Appl. No. 13/328,776, Response filed Apr. 10, 2013 to Restriction Requirement mailed Feb. 14, 2013", 11 pgs.

"U.S. Appl. No. 13/328,776, Response filed Sep. 20, 2013 to Non Final Office Action mailed Jun. 21, 2013", 19 pgs.

"U.S. Appl. No. 13/328,776, Restriction Requirement mailed Feb. 14, 2013", 5 pgs.

"Dual Action, Deep Bend", Mighton Products LTD, (Oct. 1, 2010), 1 pg.

"Reverse Retrofit Right Hand"; Angel Ventlock™ Products | Reverse Retrofit—Duel Action | Mighton Products—http://www.angel-ventlock.com/angel-ventiock-products/dual-action/reverse-retrofit, 3 pgs.

Sopkowiak, J., et al., "Sash Limited Apparatus and Method", U.S. Appl. No. 13/328,776, filed Dec. 16, 2011, 67 pgs.

Sopkowiak. J., et al., "Sash Limiter Apparatus and Method", U.S. Appl. No. 61/486,813, filed May 17, 2011, 63 pgs.

"Canadian Application Serial No. 2,886,226, Office Action mailed Feb. 16, 2016", 5 pgs.

"U.S. Appl. No. 14/565,144, Non Final Office Action mailed Jan. 14, 2016", 14 pgs.

(56) References Cited

OTHER PUBLICATIONS

"U.S. Appl. No. 14/565,144, Restriction Requirement mailed Sep. 10, 2015", 6 pgs.

U.S. Appl. No. 14/565,144, Final Office Action mailed Jun. 17, 2016, 7 pgs.

U.S. Appl. No. 14/565,144, Response filed Apr. 14, 2016 to Non Final Office Action mailed Jan. 14, 2016, 20 pgs.

* cited by examiner

WINDOW OPENING CONTROL DEVICE FOR HORIZONTAL AND VERTICAL SLIDING WINDOWS

CLAIM OF PRIORITY

This patent application claims the benefit of priority to U.S. Provisional Application No. 61/967,837, filed Mar. 27, 2014, which is hereby incorporated by reference herein in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Marvin Cedar Co. d/b/a Marvin Windows and Doors, Warroad Minn., USA. All Rights Reserved.

TECHNICAL FIELD

This document pertains generally, but not by way of limitation, to control devices for the limited opening of windows

BACKGROUND

Accidental falls from elevated windows (for instance, second-floor windows or higher) are a safety concern, especially with young children. For instance, a small child might open a window or go to an already-open window and lean out, lean against a screen, climb out, or the like. The small child could lose his/her balance or the screen could give way, and the child could fall out of the window. Depending on the height of the window above ground level, such a fall could result in injury and/or death. Certain building standards have been developed to require that windows include features to limit the amount that the windows can be opened. For instance, ASTM F2090 addresses window fall prevention devices with emergency escape (egress) release mechanisms.

OVERVIEW

Brief Description of the Drawings

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
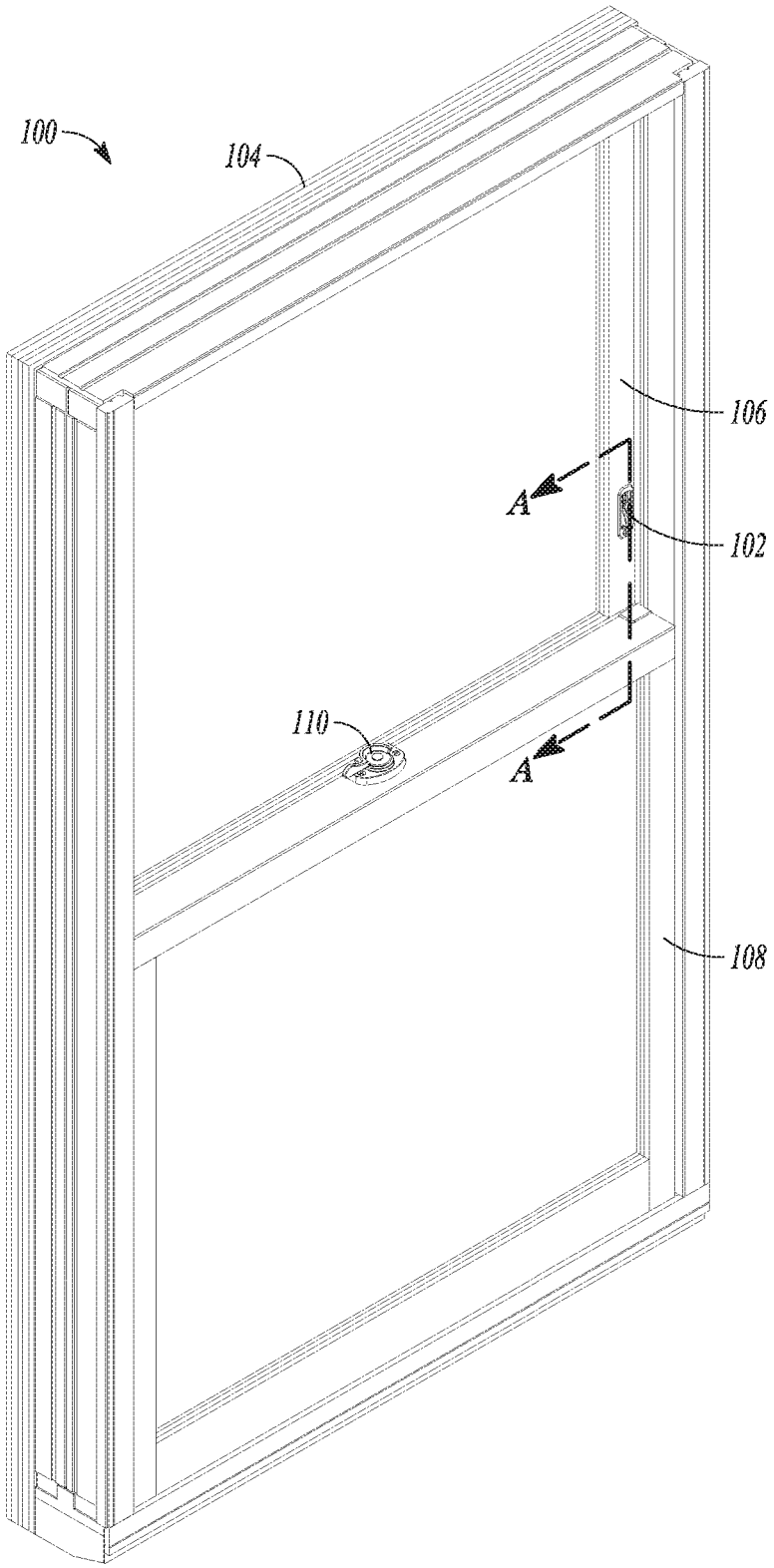
FIG. 1 is a perspective view of one example of a window assembly with sash limiter assemblies in the engaging position.

FIG. 1 shows a perspective view of one example of a window assembly 100. The window assembly 100, as described herein, is installed in dwellings, commercial buildings, or the like. The views shown herein (e.g., FIG. 1) are readily reoriented so that the window assembly 100 shown in a vertical orientation is also usable in a horizontal orientation. In an example, the window assembly 100 includes, but is not limited to, a window frame 104, a first sash 106 (e.g., a top sash), a second sash 108 (e.g., a bottom sash), a lock 110 (e.g., a keeper), and one or more sash limiter assemblies 102. The first sash 106 is slidably positioned within the window frame 104 and is thereby able to translate within the window frame 104. In yet another example, the second sash 108 is slidably positioned within the window frame 104 and translates within the window frame 104. In still another example, one of the first and second sashes 106, 108 (the second sash 108 in FIG. 1) are slidably positioned within the window frame 104 while the other sash is fixed within the window frame 104. Optionally, the first and second sashes 106, 108 translate horizontally, for instance, when the window assembly 100 is configured for a horizontal installation. While the examples described herein are provided in the form of a window, in other examples the devices and assemblies described herein are used in other fenestration assemblies including doors (e.g., sliding doors).

As described above, in use one or more of the first or second sashes 106, 108 translates vertically or horizontally according to the window assembly 100 installation. The lock 110 shown in FIG. 1 is, in one example, a latch associated with the second sash 108 and is configured for receipt with a keeper coupled with the first sash 106. The lock 110 fixes the first sash 106 and the second sash 108 and arrests both of the sashes from moving from the closed configuration (shown in FIG. 1).

Referring again to FIG. 1, in one example, one or more sash limiter assemblies 102 are coupled with the first sash 106 and configured to intercept and selectively prevent full translation of the second sash 108. In another example, two or more sash limiter assemblies 102 are coupled to the first sash 106 and at least two assemblies 102 are positioned on opposed stiles 206 of the first sash 106. Two or more sash limiter assemblies 102 are installed on a product for further security, compliance with regulations or the like. Alternatively, the sash limiter assembly 102 is coupled to the window frame 104. In yet another example, one or more sash limiter assemblies 102 are coupled to the window frame 104 and each is positioned on opposite members of the window frame 104 (e.g., the jambs).

The sash limiter assembly 102 is coupled to one or more of the first sash 106, second sash 108, the window frame 104 or the like by use of fasteners including, but not limited to, screws, bolts, nails or the like, for instance extending through corresponding fastener apertures of the limiter housing (200 as described herein). In another example, the sash limiter assembly 102 is coupled to the first sash 106, second sash 108, or the window frame 104 by use of adhesives, welds, mechanical fittings or the like.

Figure 2:
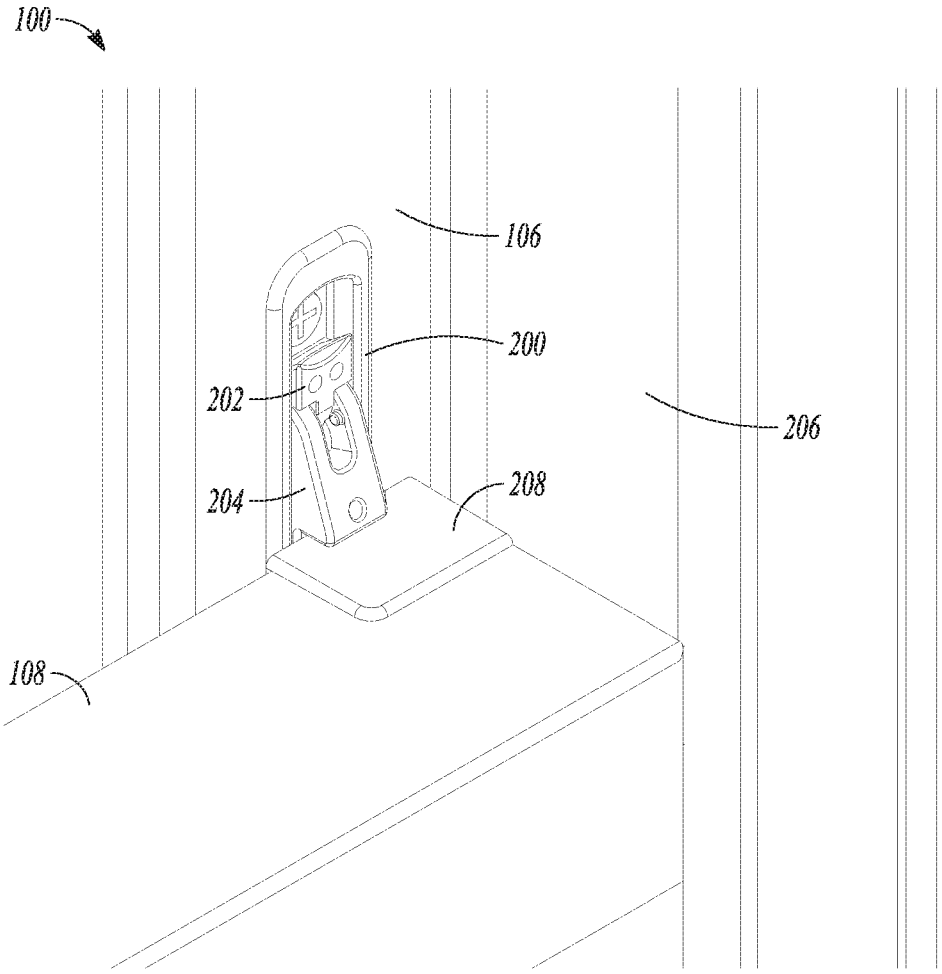
FIG. 2 is a perspective view of the window assembly with a sash engaging with one or more sash stops.

FIG. 2 is a detailed perspective view of the window assembly 100 of FIG. 1 in a partially open configuration with the second sash 108 engaged with a sash stop 204 of the sash limiter assembly 102. As shown in FIG. 2, the sash limiter assembly 102 includes, but is not limited to, a limiter housing 200, a reset 202, and a sash stop 204. The sash stop 204 is deployed in FIG. 2 and intercepts the second sash 108 to prevent further translation (e.g., in the opening direction). As will be described in detail herein, the sash limiter assembly 102 is positioned between a sash limiting configuration and a resetting configuration. As described herein, in the sash limiting configuration the sash limiting assembly 102 prevents the translation of the first and second sash 106, 108 beyond a specified opening. As shown in FIG. 2, in the sash limiting configuration, the sash stop 204 is in an engaging position within the translation path of the second sash 108.

As will be described herein, in a resetting configuration, the sash limiter assembly 102 allows the second sash 108 to translate past the sash limiter assembly 102, for instance toward a full open position. Similarly, the first sash 106 is also movable to a fully open position. In the resetting configuration the sash stop 204 is in a retained position such that the sash stop 204 is out of alignment with the translation path of the second sash 108. The sash stop 204 is optionally held in the retained position by the reset 202 and released from the retained position by movement of the reset 202.

In one example, the sash limiter assembly 102 limits the travel of the first and second sashes 106, 108 of the window assembly 100 to meet child fall protection codes. For instance, the sash limiter assembly 102 limits the opening of either the first or the second sash 106, 108 to no more than 4 inches when installed at a corresponding position on the window assembly 100. While in the sash limiting configuration the sash limiter assembly 102 prevents the second sash 108 from opening greater than 4 inches (based on the sash limiter assembly 102 installation). The sash stop 204 of the sash limiter assembly 102 extends from the first sash 106 (as shown in FIG. 2) and also extends above the check rail of the second sash 108 (e.g., from the limiter housing 200) and intercepts the second sash 108 or a stop plate 208 on the second sash 108. To facilitate movement of the first and second sashes 106, 108 beyond the sash stop 204 the sash limiter assembly 102 is set to a bypass mode (e.g., the resetting configuration) by a two-step operation to facilitate opening of the sash fully, such as for egress. In yet another example, and as described herein, movement of the sash (e.g., the first or second sash 106, 108) past the sash limiter assembly 102 in the resetting configuration automatically resets the sash limiter assembly 102 to the sash limiting configuration (releases the sash stop 204) and thereby limits opening of either of the sashes 106, 108 to the selected opening (e.g., 4 inches) according to the installation of the limiter assembly 102.

Optionally, in the resetting configuration (further shown herein) the sash limiter assembly 102 is substantially flush with the component it is installed with (e.g., a sash, frame portion or the like). In the sash limiting configuration the sash stop 204 projects from the component (e.g., the first sash 106 or frame 104). Because the sash limiter assembly 102 is flush or nearly flush in the resetting configuration (e.g., the bypass mode), the sash limiter assembly 102 is used in a wide array of window products having varying offsets and clearances between the first and second sashes 106, 108. Stated another way, the compact shape of the sash limiter assembly 102, for instance in the resetting configuration, allows for the use of the sash limiter assembly 102 in a variety of windows having differing spacing between interior and exterior sashes (i.e., the first and second sashes 106, 108).

Figure 3A:
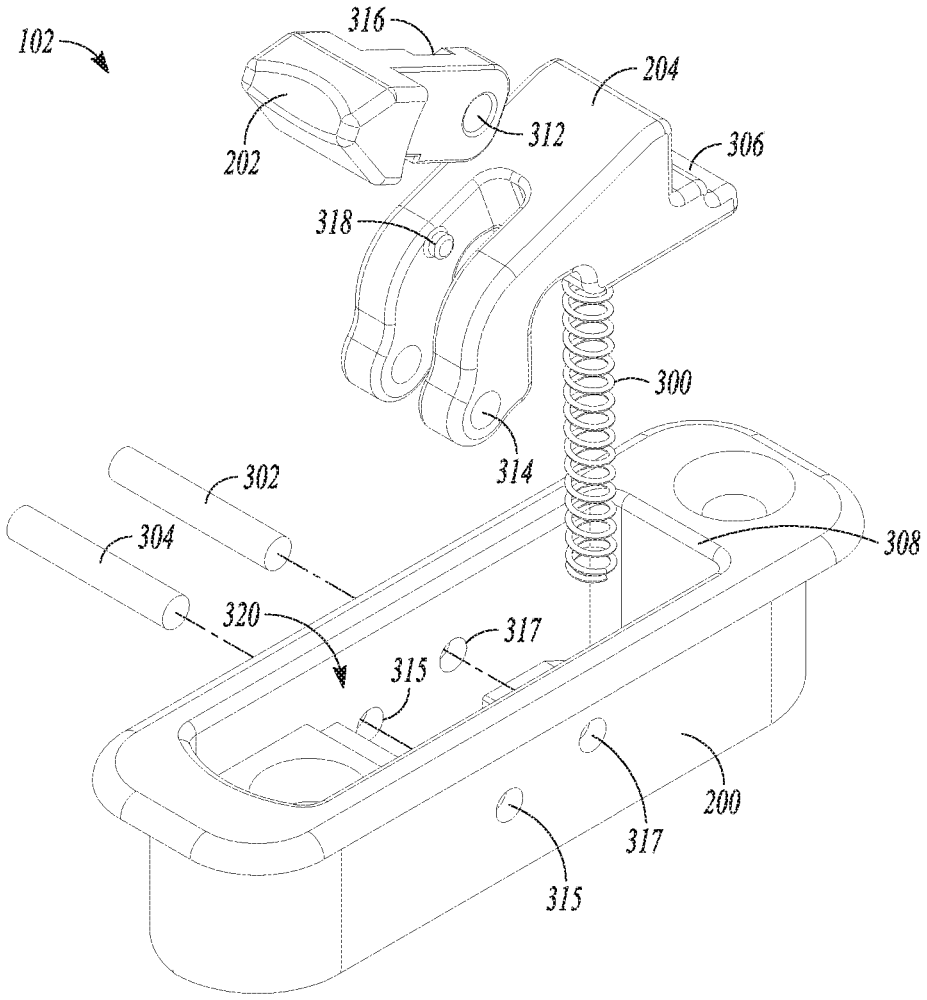
FIG. 3A is an exploded view of an example of a sash limiter assembly.

FIG. 3A is a first exploded view of an example of the sash limiter assembly 102. The exemplary sash limiter assembly 102 shown includes a sash stop 204 and a reset 202 configured to release the sash stop 204 from the resetting configuration (see FIGS. 5A, B). Optionally, the sash stop 204 and the reset 202 are housed in a limiter housing 200, and the limiter housing 200 is fit within a corresponding recess in the window assembly 100 (e.g., within a stile of a sash or a portion of the frame 104). In another example, the sash stop 204 and the reset 202 are installed within a recess of the window assembly 100 without the limiter housing 200. As shown in FIG. 3A, the sash stop 204 is rotatably coupled with the limiter housing 200 with a stop pivot 304 received within a stop pivot recess 314. Similarly the reset 202 is rotatably coupled with the limiter housing 200 with a reset pivot 302 received within a reset pivot recess 312.

Referring again to FIG. 3A, a biasing element 300 is interposed between the sash stop 204 and the limiter housing 200 (or sash or frame component if the housing is absent). The biasing element 300 includes, but is not limited to, a compression spring, torsion spring (e.g., wrapped around the stop pivot 304), elastomer or the like. In one example, the biasing element 300 includes, but is not limited to, one or more of steel, stainless steel or the like. The limiter housing 200 includes a recess, cavity or the like to retain an end of the biasing element opposed to the end coupled with the sash stop 204. In one example, the limiter housing 200 includes, but is not limited to, one or more of zinc, aluminum, a polymer or the like. Optionally, the limiter housing 200 is constructed by way of die casting, injection molding or the like. The sash stop 204 has a corresponding recess within the sash stop 204 to retain an end of the biasing element 300 within the sash stop 204. During assembly, the biasing element 300 is placed in the limiter housing 200 (e.g., within a recess or cavity in the housing) and the sash stop 204 is coupled with the limiter housing 200 such that the sash stop flange 306 is placed under a housing flange 308 and the biasing element 300 is placed inside the recess within the sash stop 204. The sash stop pivot 304 is inserted through the stop pivot recess 314 and aligned holes 315 provided on the limiter housing 200. In one example, the sash stop 204 includes, but not limited to, one or more of zinc, aluminum, a polymer or the like. Optionally, the sash stop 204 is constructed by way of die casting, injection molding or the like The stop pivot 304 in combination with the housing flange 308 retains the sash stop 204 within the limiter housing 200 (e.g., within a limiter cavity 320). Additionally, the sash stop 204 is able to rotate about the stop pivot 304. The biasing element 300 biases the sash stop 204 toward the engaging position (e.g., projected as shown in FIG. 2) with the sash stop 204 within the translation path of the second sash 108. When the sash stop 204 is in the engaging position, the sash stop flange 306 is engaged with the housing flange 308 and held at the engaging position. Further, the housing flange 308 prevents additional rotation of the sash stop 204 when engaged by the second sash 108 (or a stop plate 208) at a sash intercepting face 324 of the sash stop 204. Stated another way, the housing flange 308 in combination with the sash stop 304 (e.g., the sash stop flange 306) locks the sash stop 304 in place and robustly supports the sash stop 304 against further rotation caused by continued movement of the second sash 108. In another example, the stop pivot 304 provides an additional support point for the sash stop 204 to prevent its displacement as the second sash 108 engages with the sash intercepting face 324. In one example, the stop pivot 304 includes, but not limited to, one or more of steel, stainless steel or the like. Optionally, the stop pivot 304 is constructed by way of stamping. The combination of the stop pivot 304 and the sash stop flange 306 distribute the load placed on the sash limiter assembly 102, by the second sash 108, throughout the limiter housing 200. In one example, the reset 202 includes, but not limited to, one or more of zinc, aluminum, a polymer or the like. Optionally, the reset 202 is constructed by way of die casting, injection molding or the like.

Figure 3B:
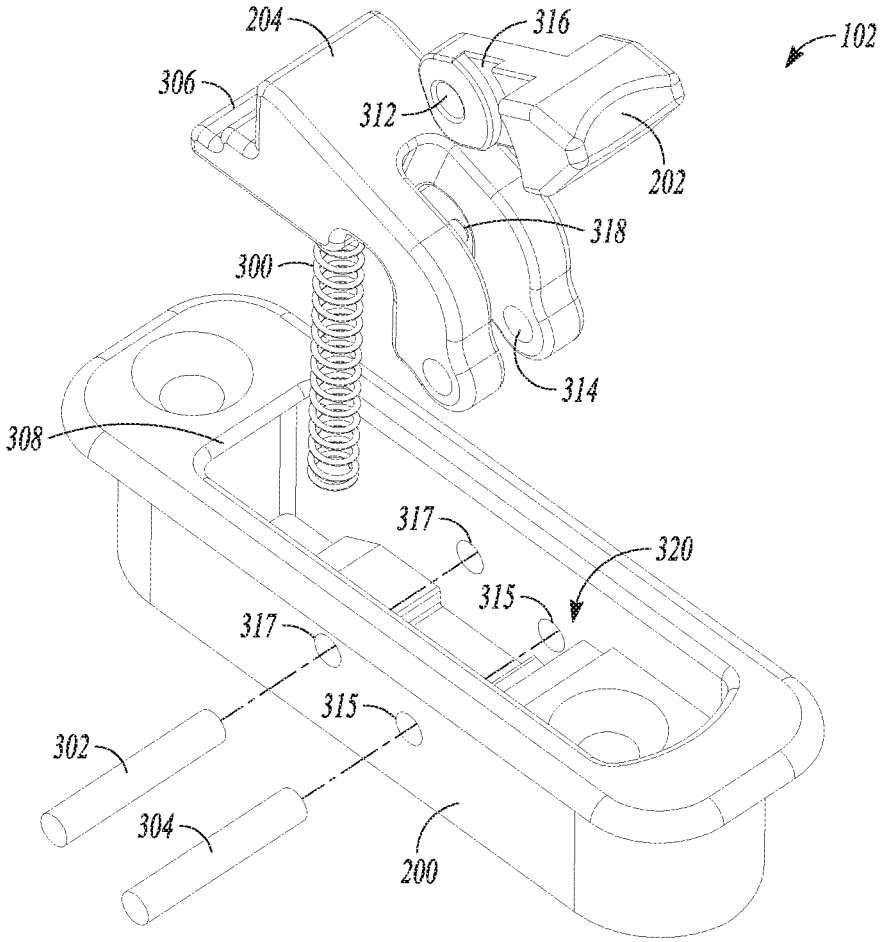
FIG. 3B is an exploded view of an example of a sash limiter assembly.

FIG. 3B is an exploded view of the sash limiter assembly 102 of FIG. 3A and shows another side of the sash limiter assembly 102. As shown, the reset 202 is placed in the void between the sash stop 204 and the stop pivot 304. The reset pivot 302 is inserted through holes 317 on the limiter housing 200 aligned with the reset pivot recess 312. The reset pivot 302 provides an axis of rotation for the reset 202. In one example, the reset pivot 302 includes, but not limited to, one or more of steel, stainless steel or the like. Optionally, the reset pivot 302 is constructed by way of stamping.

Figure 3C:
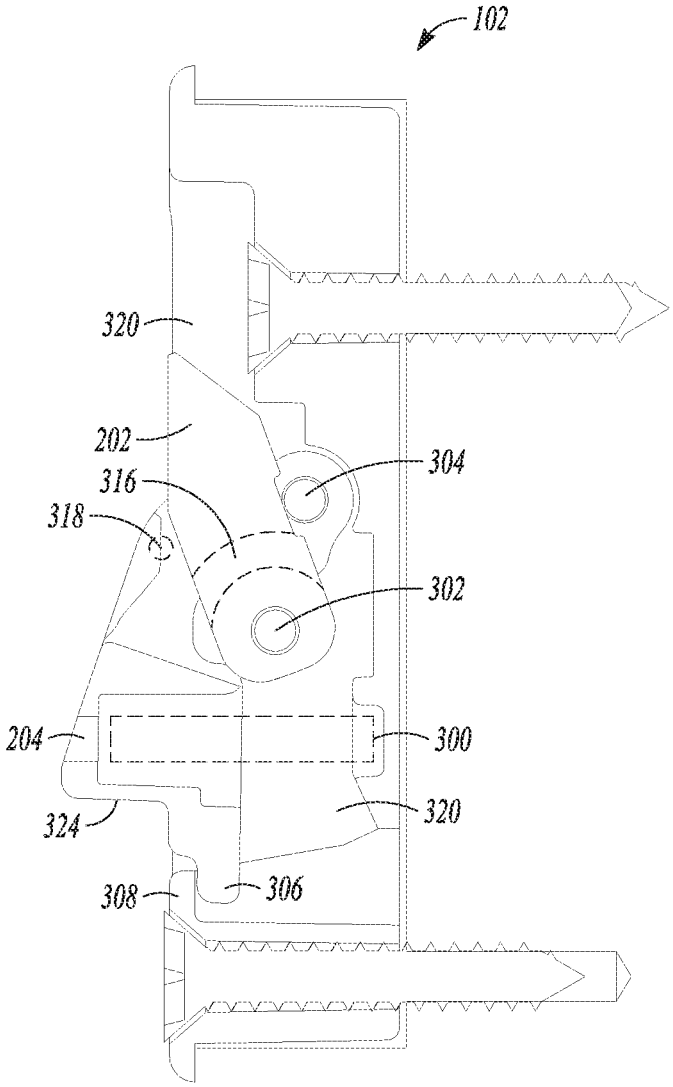
FIG. 3C is a detailed sectional view, taken at the line A-A of FIG. 1, of the sash limiter assembly of FIGS. 3A and 3B.

In one example, the reset 202 has a retaining pin channel 316. The retaining pin channel 316 is sized and shaped for reception of a stop retaining pin 318 within the retaining pin channel 316. As shown in FIG. 3A, the stop retaining pin 318 extends from the sash stop 304. In another example, the retaining pin channel 316 is located on the sash stop 204, and the stop retaining pin 318 is located on the reset 202. As will be described herein, the engagement of the stop retaining pin 318 with the walls of the retaining pin channel 316 facilitates the retention of the sash stop 204 in a depressed position for the resetting configuration. For instance, rotation of the reset 202 to the resetting position (extending from the limiter housing 200) forces the sash stop 204 into the limiter housing 200 as the stop retaining pin 318 (and the sash stop 204) is forced to travel along the retaining pin channel 316. The engagement of the retaining pin channel 316 (the channel walls) with the stop retaining pin 318 holds the stop 204 in the retained position with the reset 202 extending upwardly from the housing 200 (and in line with the translation of the second sash 108). In one example, the reset 202 includes, but not limited to, one or more of zinc, aluminum, a polymer or the like. Optionally, the reset 202 is constructed by way of die casting, injecting molding or the like FIG. 3C is a sectional view of the sash limiter assembly 102 of FIG. 3A. In an example, when the sash limiter assembly 102 is in the sash limiting configuration, the reset 202 is within the limiter cavity 320. When the user wants to change the sash limiter assembly 102 into the bypass mode, the user depresses the sash stop 204 into the limiter cavity 320 (overcoming the bias of the biasing element 300). The depression of the sash stop 204 aligns the retaining pin channel 316 (See FIG. 3B) of the reset 202 with the stop retaining pin 318 (See FIG. 3A) of the sash stop 204. Stated another way, the stop retaining pin 318 and the retaining pin channel 316 are out of alignment if the sash stop 204 is not depressed to prevent the reset 202 from rotating about the reset pivot 302 in one example.

In another example when the window assembly 100 is in a vertical orientation (as shown in FIG. 1), the reset 202 is loosely coupled with the reset pivot 302 to allow free rotation (e.g., because of gravity). The loose coupling between the reset 202 and the reset pivot 302 allows the reset 202 to automatically move toward the resetting position when the sash stop 204 is depressed into the limiter cavity 320 (e.g., the reset 202 falls and rotates according to gravity). Stated another way, when the sash stop 204 is depressed, the force of gravity will move the reset 202 toward the resetting position. When two or more sash limiter assemblies 102 are installed on a window assembly 100, the automatic movement of the reset 202 reduces user interaction with the sash limiter assembly 102 while still complying with regulations (e.g., the requirement for two interactions with the window assembly 100 before the second sash 108 or first sash 106 will translate past a specified distance).

Alternatively, one or more sash limiter assemblies 102 are installed in a window assembly 100 that is in a horizontal orientation while still complying with regulations. In an example, one sash limiter assembly 102 is installed because the user manually moves the reset 202 into the resetting position (e.g., after depressing the sash stop 204). In the horizontal configuration, the user thereby performs two or more operations on the sash limiter assembly 102 to open the second sash 108 (or first sash 106) more than a specified distance (based on one or more of installation and in compliance with a regulation).

Referring again to FIG. 3C, when the user rotates the reset 202, the stop retaining pin 318 (See FIG. 3A) moves inside the retaining pin channel 316 (See FIG. 3B). In one example, the reset 202 rotates a specified amount (e.g., around 90 degrees) before the stop retaining pin 318 reaches the end of the retaining pin channel 316. In another example, the reset 202 rotates a specified amount before the reset 202 intercepts a portion of the sash stop 204 (e.g., a top of the depressed sash stop). In yet another example, with the stop retaining pin 318 within the retaining pin channel 316, the sash stop 204 is held in the depressed position and prevented from rising to the engaging position through bias of the biasing element 300 (i.e., the sash stop is in the retained position). Stated another way, when the reset 202 is rotated and the stop retaining pin 318 is within the retaining pin channel 316, the sash stop 204 is locked in the retained position and the sash limiter assembly is in the resetting configuration (e.g., the bypass mode).

Figure 5A:
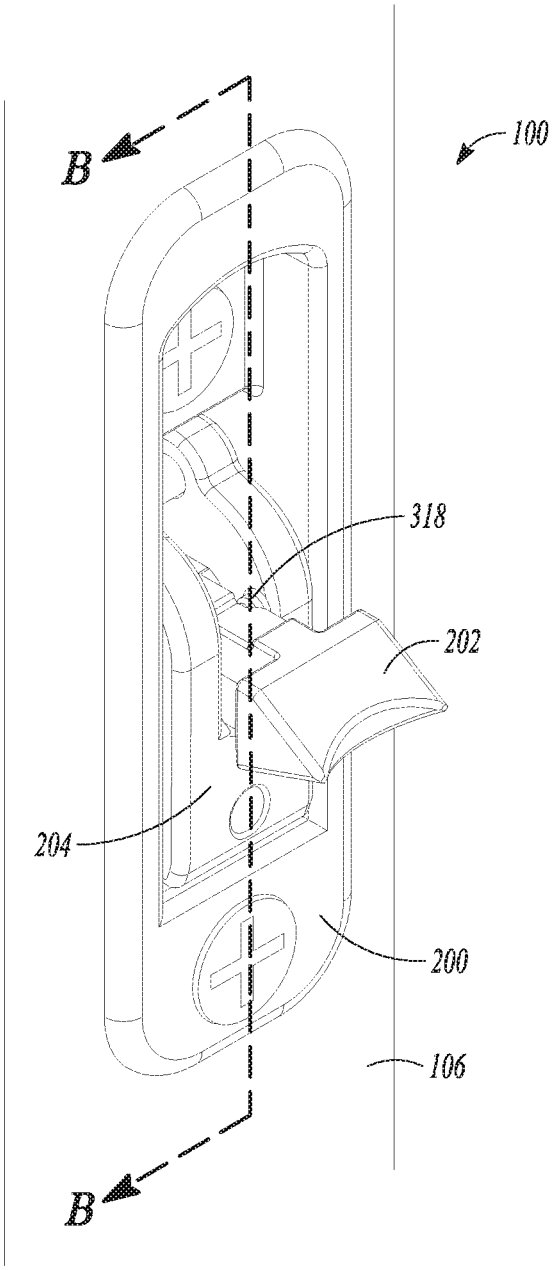
FIG. 5A is a perspective view of one example of a sash limiter assembly in a retained configuration with an example reset in the resetting position.
Figure 5B:
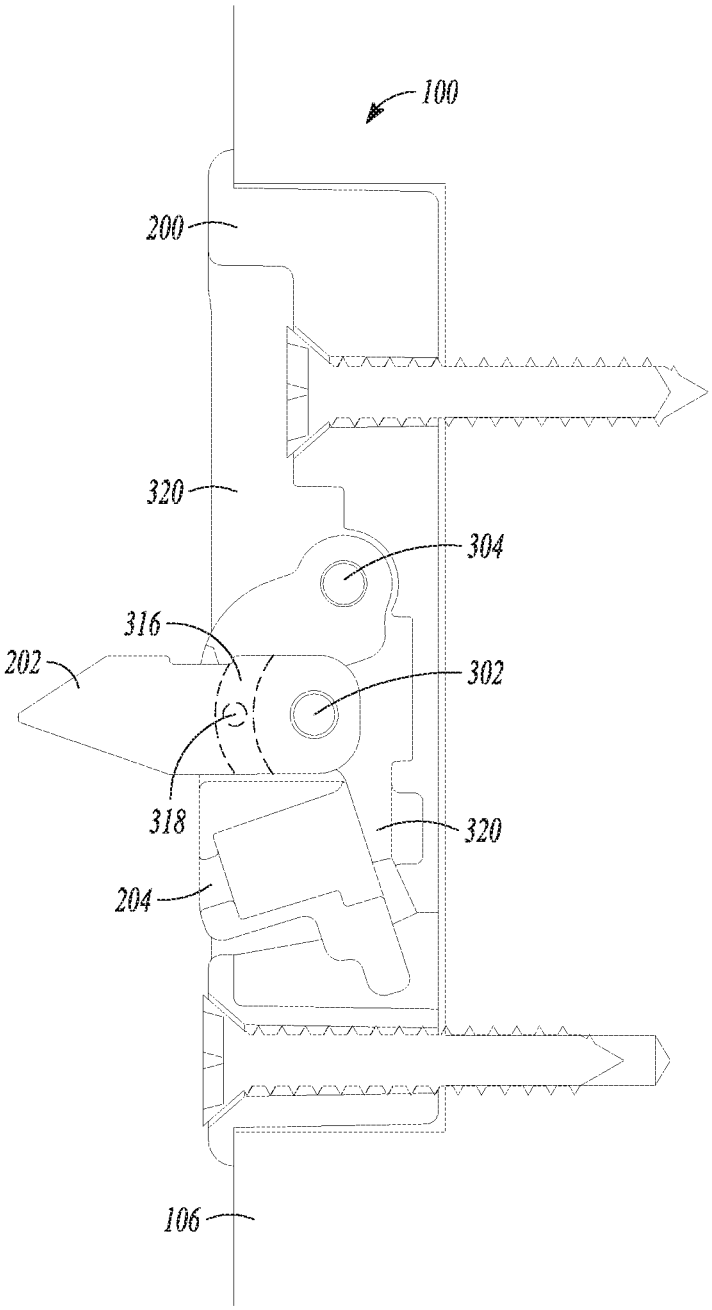
FIG. 5B is a sectional view, taken at the line B-B of FIG. 5A, of the sash limiter assembly of FIG. 5A.

As described in further detail herein, when the sash limiter assembly 102 is in the bypass mode, the sash stop 204 is retained substantially within the limiter cavity 320 (See FIG. 5B). In the bypass mode, the sash intercepting face 324 of the sash stop 204 is positioned outside of the translation path of the second sash 108 and the second sash 108 is able to translate past the sash stop 204. In another example with the sash limiter assembly 102 installed with the second sash 108 or the frame, in the bypass mode the sash intercepting face 324 of the sash stop 204 is positioned outside of the translation path of the first sash 106 and the first sash 106 is able to translate past the sash stop 204.

As described further herein, as the second sash 108 translates past the sash stop 204 (depressed and retained in the limiter cavity 320), the second sash 108 engages with and rotates the reset 202. The second sash 108 rotates the reset 202 and thereby releases the sash stop 204. Rotation of the reset 202 moves the stop retaining pin 318 out of the retaining pin channel 316 and thereby releases the sash stop 204. The sash limiter assembly 102 accordingly transitions out of the bypass mode (i.e., the resetting configuration) and the sash stop 204 is biased back toward the engaging position (e.g. projected as shown in FIG. 2 once the second sash 108 is removed from over top of the sash stop 204).

Figure 4A:
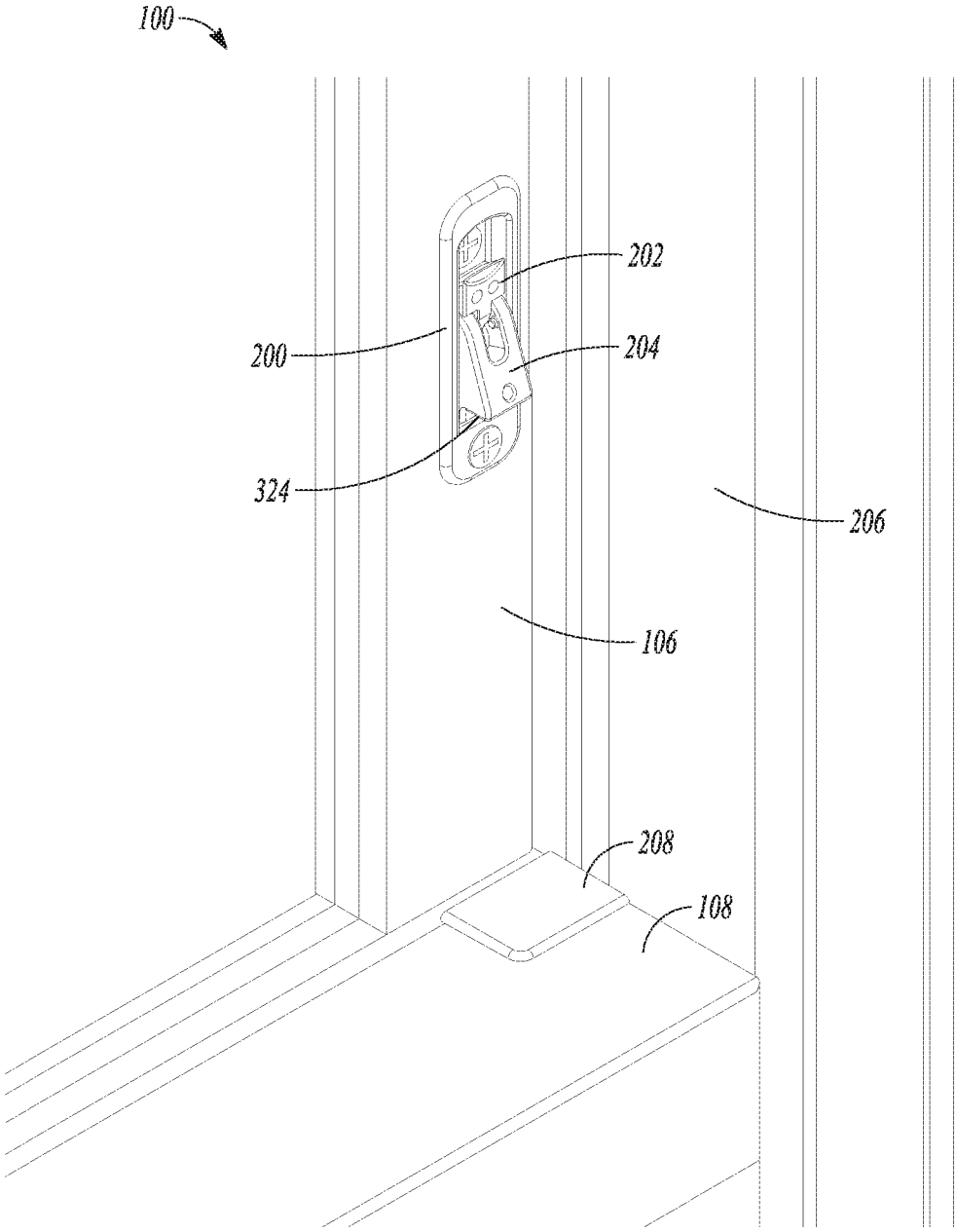
FIG. 4A is a perspective view of one example of a sash limiter assembly in a sash limiting configuration.

FIG. 4A is a detailed perspective view of the window assembly 100 with the sash limiter assembly 102 in a sash limiting configuration. With the sash limiter assembly 102 in the sash limiting configuration the sash stop 204 is in an engaging position such that the sash intercepting face 324 (See FIG. 3C) of the sash stop 204 will intercept the second sash 108 (or the stop plate 208 of the second sash 108) with movement of the second sash toward the sash stop. In the sash limiting configuration, the sash limiter assembly 102 prevents the second sash 108 from translating past a certain point (dependent upon installation location). In another example, the sash limiter 102 prevents the second sash 108 from opening greater than 4 inches (based on the sash limiter assembly 102 installation). As described herein, the user is able to translate the second sash 108 a specified distance until the second sash 108 is intercepted by the sash limiter assembly 102 (e.g., after the second sash 108 translates four inches).

Figure 4B:
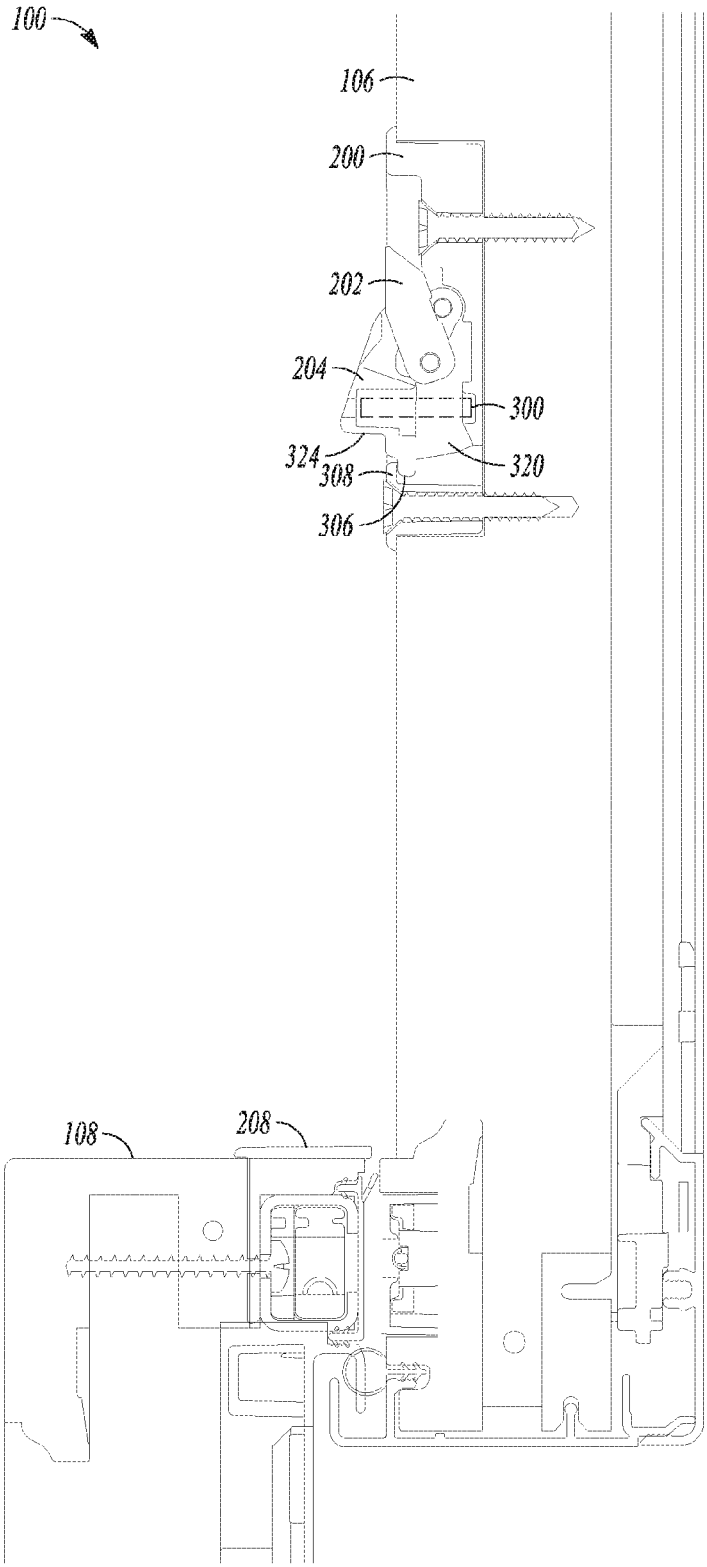
FIG. 4B is a sectional view, taken at the line A-A of FIG. 1, of the sash limiter assembly of FIG. 4A.

FIG. 4B is a sectional view of the window assembly 100 of FIG. 4A. As described herein, in the sash limiting configuration the sash stop 204 is biased by the biasing element 300 toward the engaging position with the sash stop 204 is positioned in the translation path of the second sash 108. The bias towards the engaging position is overcome when the user depresses the sash stop 204 into the limiter cavity 320. In combination with the coupling of the sash stop 204 to the stop pivot 302 (FIG. 3C) the engagement of the sash stop flange 306 and the housing flange 308 locks the sash stop 304 in place and robustly supports the sash stop 304 against further rotation otherwise caused by continued movement of the second sash 108.

FIG. 5A is a detailed perspective view of an example of the window assembly 100 with the sash limiter assembly 102 in the resetting configuration. As described herein, the reset 202 is rotated into the translation path of the second sash 208 under certain conditions, for instance where opening of a sash, such as the second sash 108, beyond the sash limiter assembly 102 is desired (e.g., for egress). In one example, the reset 202 is rotated when the stop retaining pin 318 is in alignment with the retaining pin channel 316. As shown in FIG. 5A, the sash stop 204 is depressed substantially within the limiter cavity 320 (e.g., the sash stop 204 is flush or recessed relative to the outer face of the sash 106). With the sash stop 204 depressed, the stop retaining pin 318 and the retaining pin channel 316 are aligned and the reset 202 is rotated from its normal position within the limiter cavity 320 to a resetting position, wherein the reset 202 is in the translation path of the second sash 108. With the reset 202 moved to the resetting position the sash stop 204 is retained substantially within the limiter cavity 320. For instance, the rotation of the reset 202 positions the stop retaining pin 318 in engagement with one or more walls of the retaining pin channel 316. The engagement of the retaining pin channel 316 (the channel walls) with the stop retaining pin 318 holds the stop 204 in the retained position. Optionally, and as discussed herein the stop retaining pin 318 and the retaining pin channel 316 are reversed with the pin on the reset 202 and the channel on the sash stop 204. In another example other features including, but not limited to, gears, latches, rollers or the like are used between one or more of the reset 202, the sash stop 204, the limiter housing 200 (or the sashes or frame) to retain the sash stop 204 in the depressed position while at the same time preparing the sash limiter assembly 102 for resetting with movement of one or more of the sashes 106, 108.

FIG. 5B is a sectional view of the window assembly 100 of FIG. 5A with the reset 202 in the resetting position. In an example, the reset 202 in the resetting position places the reset 202 within the translation path of the second sash 108 while the sash stop 204 is retained within the limiter cavity 320. In the resetting position, the second sash 108 is able to translate past the sash stop 204 (e.g., to provide a large opening) and engages with the reset 202. In another example, the first sash 106 is able to translate toward an open position (i.e., a larger opening than with the sash stop 204 in the sash limiting configuration). Stated another way, when the sash limiter assembly 102 is in the resetting configuration, one or more of the first or the second sashes 106, 108 may be translated past the sash limiter assembly 102 and reset the sash limiter assembly 102 as described herein.

Figure 6A:
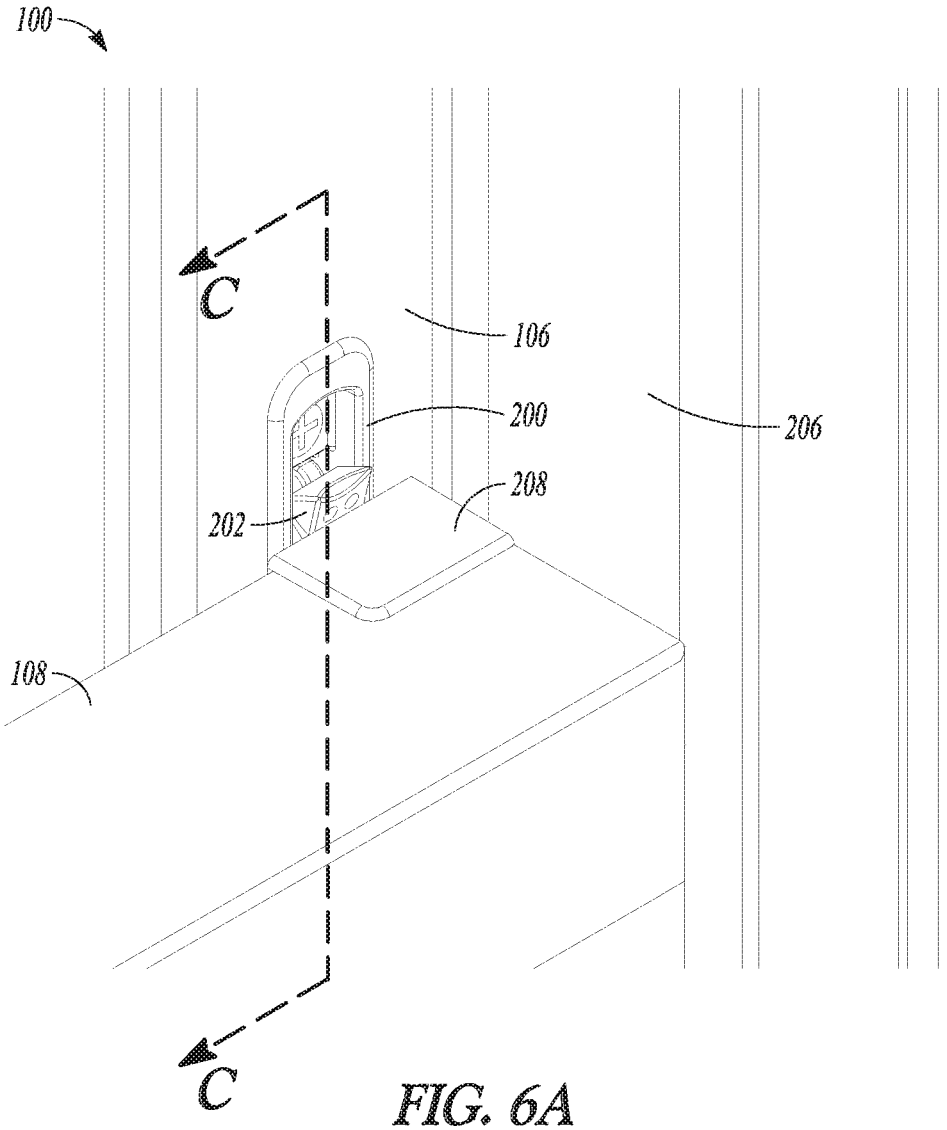
FIG. 6A is a perspective view of one example of a sash limiter assembly with the sash engaged with the reset.

FIG. 6A is a detailed perspective view of the window assembly 100 with the stop plate 208 of the second sash 108 engaged with the reset 202. As the second sash 108 engages with the reset 202 and continues to move over the sash limiter assembly 102 the reset 202 is moved from its resetting position toward its stowed position within the limiter cavity 320. In the stowed position reset 202 is disengaged from sash stop 204 to accordingly release the sash stop to project from the limiter housing 200 (e.g., to project from the housing or the sash after disengagement of the sash from over top of the sash stop 204).

Figure 6B:
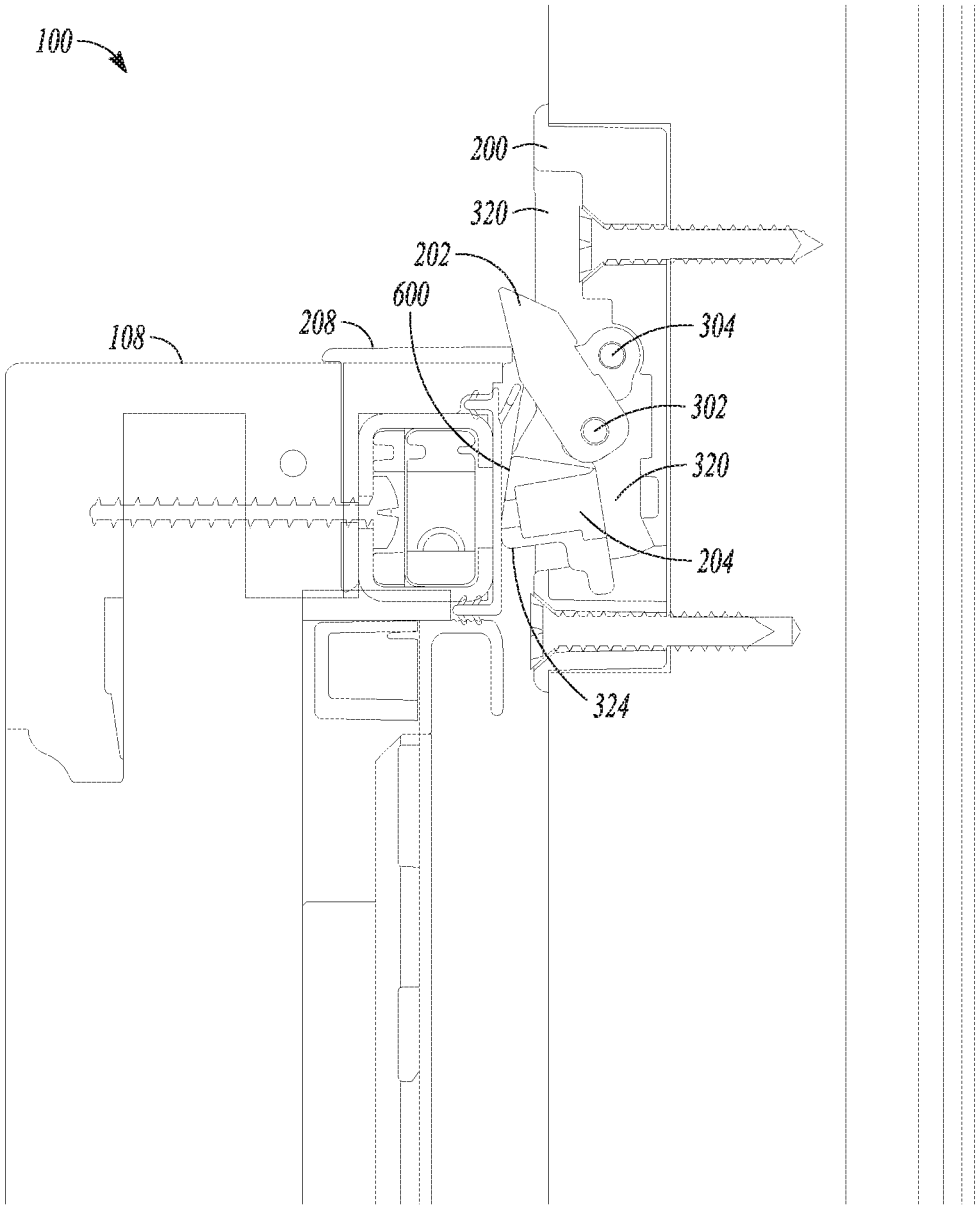
FIG. 6B is a sectional view, taken at the line C-C of FIG. 6A, of the sash limiter assembly of FIG. 6A.

FIG. 6B is a sectional view of the window assembly 100 of FIG. 6B. As shown in FIG. 6A and shown again in FIG. 6B, the stop plate 208 of the second sash 108 engages with the reset 202 to move the reset 202 (e.g., rotate the reset) from the resetting position toward the stowed position within the limiter cavity 320. Rotation of the reset 202 moves the stop retaining pin 318 out of the retaining pin channel 316 (See FIGS. 3A and 3B) and thereby releases the sash stop 204 to transition back to the engaging position (shown in FIGS. 4A, B) after the sash is moved from over top of the sash stop. The sash limiter assembly 102 accordingly automatically transitions out of the bypass mode (i.e., the resetting configuration) and the sash stop 204 is biased back toward the engaging position (e.g. projected as shown in FIGS. 2, 4A, B) once the second sash 108 is removed from over top of the sash stop 204.

The engagement of the second sash 108 with the reset 202 and movement of the reset 202 by the second sash 108 releases the sash stop 204. With the sash positioned as shown in FIGS. 6A, B the sash intercepting face 324 of the sash stop 204 is not engaged with the second sash 108 (and the second sash 108 is not prevented from translating towards the fully open position). Instead, a sash stop ramp 600 of the sash stop 204 slides along the second sash 108 as the second sash 108 travels over the sash limiter assembly 102 (e.g., towards a fully open position or toward the closed position). Once the second sash 106 is removed from over the top of the sash stop 204 (e.g., translated past the sash stop 204 during closing movement), the sash stop 204 moves and projects as shown in FIG. 2, for instance according to the bias of the biasing element 300.

Figure 7A:
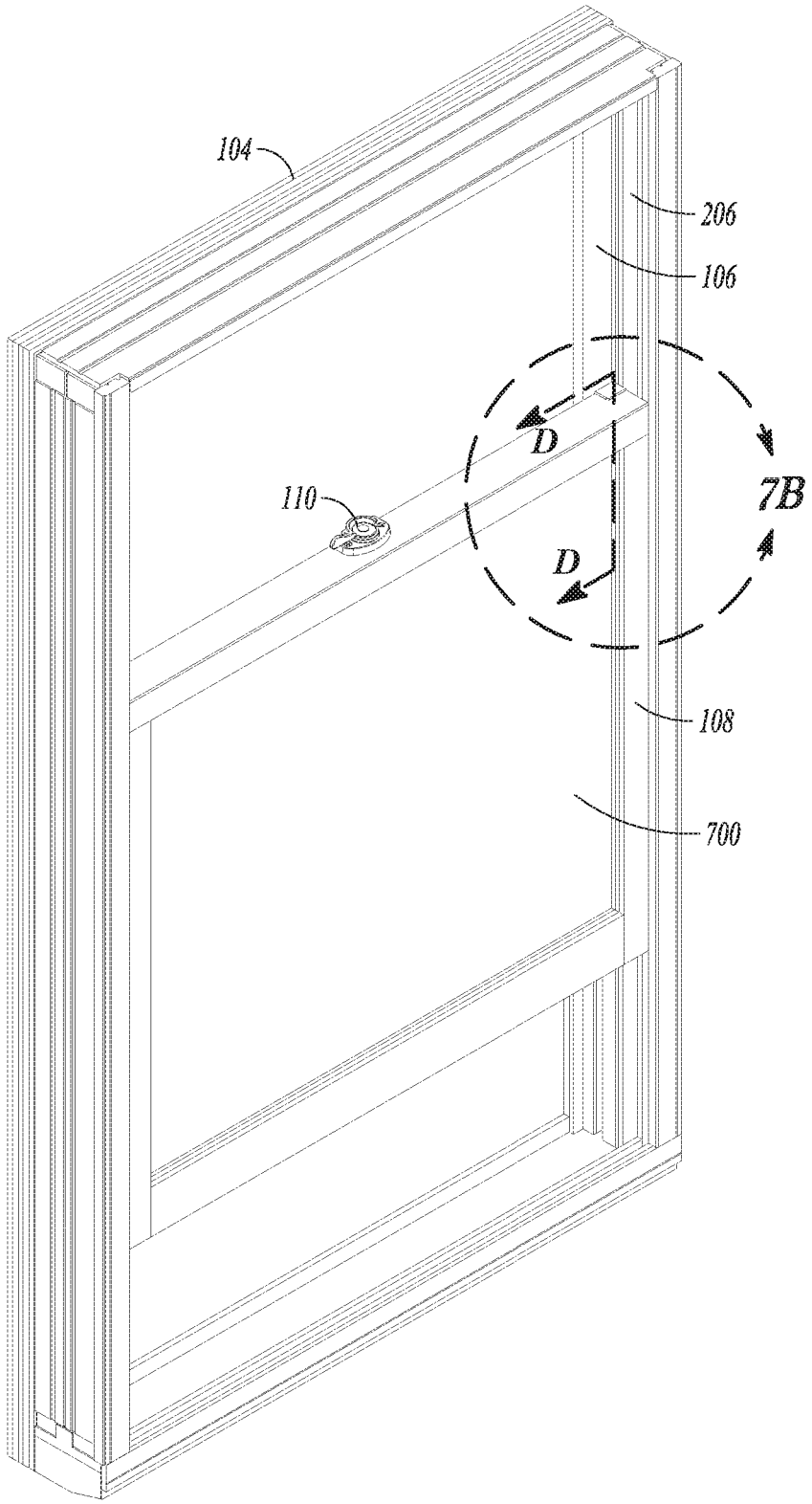
FIG. 7A is a perspective view of one example of a sash moved past the sash limiter assembly.
Figure 7B:
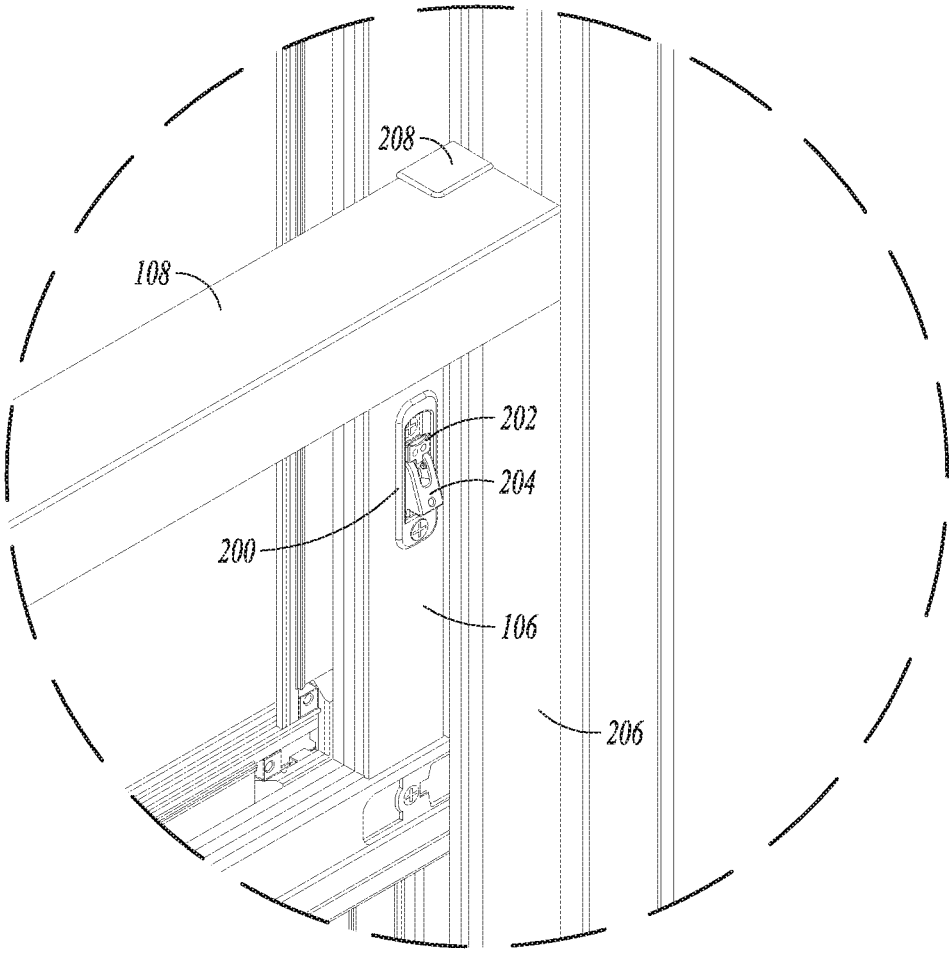
FIG. 7B is a detailed perspective view of the sash limiter assembly of FIG. 7A.

FIG. 7A is a perspective view of an example of a window assembly 100. The second sash 108 is in a partially open position (e.g., is open greater than the limited position shown in FIG. 2). The second sash 108 is positioned over a portion of the first sash 106 and a lower pane of glass 700 obscures the sash limiter assembly 102 from view. The detail of FIG. 7A, FIG. 7B, shows the pane of glass 700 removed to expose the sash limiter assembly 102. In an example with the second sash 108 translated past the sash limiter assembly 102 (e.g., after having reset the sash limiter assembly 102 as described herein), the second sash 108 is able to continue translating toward a fully open position, or is able to translate towards the fully closed position. As described above, the sash stop 204, previously released with movement of the reset 202, is biased outwardly but fails to interrupt movement of the second sash 108 until the second sash 108 is moved from an overlying position. Stated another way, the sash stop 204 projects to the engaging position once the second sash 108 is moved out of the way.

As described above, FIG. 7B is a detailed perspective view of the window assembly 100 of FIG. 7A with the lower pane of glass 700 removed to show the otherwise obscured sash limiter assembly 102. As described herein, the second sash 108 translates past the sash limiter assembly 102 once the sash limiter assembly 102 is in the resetting configuration (e.g., the sash stop 204 is depressed, held and then eventually released by the reset 202). When the second sash 108 has translated past the sash limiter assembly 102, the second sash 108 translates freely within the window frame 104 (i.e., towards the fully closed or fully open position) without interception by the sash limiter assembly 102. The second sash 108 translates freely because the second sash 108 has engaged and moved the reset 202 while the sash stop 204 was retained in the depressed position. While the second sash 108 remains positioned over the released sash stop 204 the sash is able to move freely. The second sash 108 freely translates because the second sash 108 will not engage with the sash intercepting face 324 until the second sash 108 is moved toward the fully closed position and translates past the sash stop 204. However, once the second sash 108 translates past the sash stop 204, the sash stop 204 projects outwardly from the limiter housing 200 to the engaging position automatically (e.g., according to the biasing element 300). To facilitate opening of the second sash 108 past the sash stop 204 again the user places the sash limiter assembly 102 into the resetting configuration (e.g., by depressing the sash stop 204 and moving the reset 202 to hold the sash stop 204 in the depressed position).

Figure 7C:
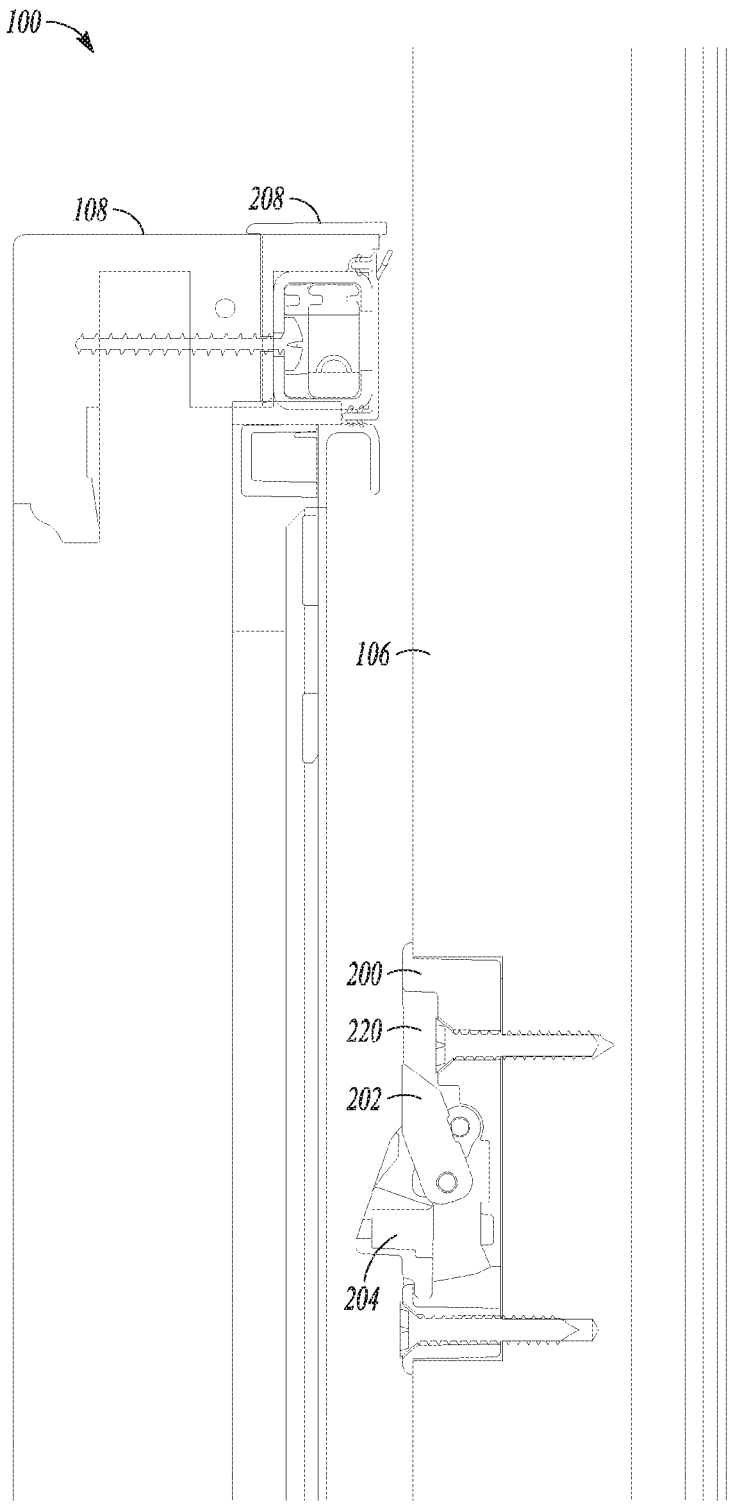
FIG. 7C is a sectional view, taken at the line D-D of FIG. 7A of the sash limiter assembly of FIG. 7A.

FIG. 7C is a sectional view of the window assembly 100 of FIG. 7A. As described herein, the second sash 108 is able to translate toward the fully open position or translate toward the fully closed position after movement of the reset 202 and release of the sash stop 204. As the user translates the second sash 108 from the position shown in FIG. 7A toward the fully closed position and past the sash stop (e.g., the top of the second sash passes over the sash stop 204) the second sash 108 slides along the sash stop ramp 600 and past the sash stop 204. Stated another way, when the second sash 108 is in the position shown in FIG. 7A, the sash stop 204 allows for full opening of the second sash 108 (and the first sash 106) toward the fully closed position. It is after passage of the second sash 108 (or first sash 106) to uncover or expose the released sash stop 204 and allow the stop to project to the engaged position that further movement of the second sash 108 (or first sash 106) is limited.

Figure 8:
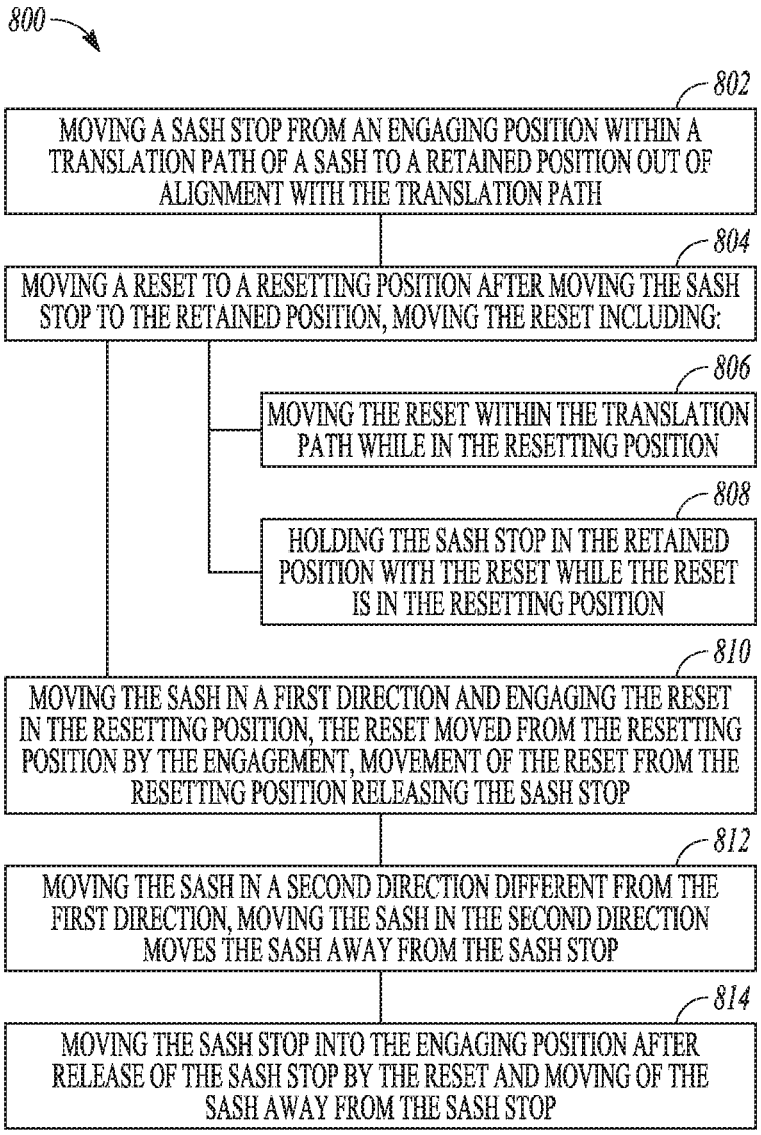
FIG. 8 is a block diagram of a method for operating one example of a sash limiter assembly.

FIG. 8 shows one example of a method 800 for using a sash limiter assembly. In describing the method 800, reference is made to one or more components, features, functions and steps previously described herein. Where convenient, reference is made to the components, features, steps and the like with reference numerals. Reference numerals provided are exemplary and are not exclusive. For instance, components, features, functions, steps and the like described in the method 800 include, but are not limited to, the corresponding numbered elements provided herein, other corresponding features described herein (both numbered and unnumbered) as well as their equivalents.

At step 802 the method 800 includes moving a sash stop 204 from an engaging position within a translation path of either a first or a second sash 106, 108 to a retained position out of alignment with the translation path. The translation path of either the first or the second sash 106, 108 is the space through which the first or second sash 106, 108 moves within the window frame 104. In an example and as described herein, the sash stop 204 is retained within the limiter cavity 320. In another example, the sash stop 204 is retained within a recess of the window assembly 100 without the limiter housing 200. In one example, moving the sash stop 204 includes depressing the sash stop 204 relative to the reset 202. In another example, moving the sash stop 204 includes rotating the sash stop 204 relative to the reset 202. In yet another example, moving the sash stop 204 includes aligning a stop retaining pin 318 with a retaining pin channel 316.

At stet 804 the method 800 includes moving a reset 202 to a resetting position after moving the sash stop 204 to the retained position. In one example, at Step 806 the method 800 includes moving the reset 202 within the translation path of either the first or the second sash 106, 108 while in the resetting position. In another example, at Step 808 the method 800 includes holding the sash stop 204 in the retained position with the reset 202 while the reset 202 is in the resetting position. In yet another example, moving the reset 202 includes rotating the reset 202 relative to the sash stop 204. In still yet another example, moving the reset 202 includes moving the reset 202 according to alignment of the stop retaining pin 318 with the retaining pin channel 316. Alternatively, holding the sash stop 204 in the retained position includes holding the stop retaining pin 318 in the retaining pin channel 316. As described herein, the stop retaining pin 318 engages with the walls of the retaining pin channel 316. The engagement of the stop retaining pin 318 with the walls of the retaining pin channel 316 facilitates the retention of the sash stop 204 in a depressed position for the resetting configuration.

At step 810 the method 800 includes moving either the first or second sash 106, 108 in a first direction (e.g., toward the fully open position) and engaging the reset 202 in the resetting position, the reset 202 is moved from the resetting position by the engagement, movement of the reset 202 from the resetting position releases the sash stop 204. For instance in one example, the reset 202 extends from the limiter housing 200 and is accordingly in the translation path. The second sash 108 translates and is intercepted by the reset 202. The reset 202 is rotated toward the limiter housing 200 with continued movement of the second sash 108. In one example, the rotation of the reset 202 disengages the stop retaining pin 318 from the retaining pin channel and releases the sash stop 204 from the retained position.

At step 812 the method 800 includes moving either the first or the second sash 106, 108 in a second direction (e.g., towards the fully closed position) different from the first direction, moving the first or second sash 106, 108 in the second direction moves the first or second sash 106, 108 away from the sash stop 204.

At step 814 the method 800 includes moving the sash stop 204 into the engaging position after release of the sash stop 204 by the reset 202 and moving of either the first or second sash 106, 108 away from the sash stop 204. In an example, the biasing element 300 moves (i.e., biases) the sash stop 204 towards the engaging position.

The method 800 includes arresting movement of either the first or second sash 106, 108 in the first direction (e.g., towards the fully open position) with the sash stop 204 in the engaging position. For instance, the sash intercepting face 324 of the sash stop 204 engages with the second sash 108 and prevents the further translation (i.e., arrests movement) of either the first or second sash 106, 108.

VARIOUS NOTES & EXAMPLES

Example 1 can include subject matter, such as can include a window assembly including a sash limiter assembly, the sash limiter assembly comprising: a limiter housing configured for installation in one or more of a sash or a window frame of a window; a sash stop movably coupled with the limiter housing, the sash stop movable between engaging and retained positions; a reset movably coupled with the limiter housing, the reset movable into a resetting position; and wherein the sash limiter assembly is configured for positioning between a sash limiting configuration and a resetting configuration: in the sash limiting configuration the sash stop is in the engaging position and configured for positioning in a translation path of the sash, and in the resetting configuration the sash stop is held in the retained position by the reset in the resetting position, in the retained position the sash stop is configured for positioning out of alignment with the translation path, and in the resetting position the reset is configured for positioning within the translation path.

Example 2 can include, or can optionally be combined with the subject matter of Example 1, to optionally include wherein the limiter housing includes a limiter cavity, and the sash stop is received within the limiter cavity in the retained position.

Example 3 can include, or can optionally be combined with the subject matter of one or any combination of Examples 1 or 2 to optionally include a biasing element coupled between the sash stop and the limiter housing, the sash stop is biased toward the engaging position by the biasing element.

Example 4 can include, or can optionally be combined with the subject matter of one or any combination of Examples 1 through 3 to optionally include wherein the biasing element includes one or more of a compression spring, a torsion spring or an elastomer.

Example 5 can include, or can optionally be combined with the subject matter of one or any combination of Examples 1-4 optionally to include wherein the limiter housing includes a housing flange, and the sash stop includes a sash stop flange, and the sash stop flange engages with the housing flange while a sash is engaged with the sash stop, and the engagement of the sash stop flange and the housing flange prevents movement of the sash past the sash stop.

Example 6 can include, or can optionally be combined with the subject matter of Examples 1-5 to optionally include wherein one or more of the sash stop and the reset are rotatable relative to the limiter housing.

Example 7 can include, or can optionally be combined with the subject matter of Examples 1-6 to optionally include wherein the sash stop is rotatable at a stop pivot, and the reset is rotatable at a reset pivot, and the reset pivot is positioned between the stop pivot and a sash intercepting face.

Example 8 can include, or can optionally be combined with the subject matter of Examples 1-7 to optionally include wherein the sash stop includes at least one of a stop retaining pin or a retaining pin channel, and the reset includes at least the one of the retaining pin channel or the stop retaining pin.

Example 9 can include, or can optionally be combined with the subject matter of Examples 1-8 to optionally include wherein in transition from the engaging position to the retained position the stop retaining pin is aligned with the retaining pin channel according to movement of the sash stop, and the reset is movable into the resetting position after the stop retaining pin is aligned with the retaining pin channel.

Example 10 can include, or can optionally be combined with the subject matter of Examples 1-9 to optionally include wherein in the resetting configuration the sash retaining pin is received within the retaining pin channel, and reception of the sash retaining pin (and engagement of the sash retaining pin with the walls of the retaining pin channel) holds the sash stop in the retained position.

Example 11 can include, or can optionally be combined with the subject matter of Examples 1-10 to optionally include wherein in the sash limiting configuration the sash retaining pin is outside of the retaining pin channel and the sash stop is released to the engaging position.

Example 12 can include, or can optionally be combined with the subject matter of Examples 1-11 to optionally include a window assembly including the sash limiter assembly coupled thereon, the window assembly including: a window frame, and one or more sashes slidably positioned within the frame, and wherein at least one sash limiter assembly is coupled between the one or more sashes, and the at least one sash limiter assembly is configured to selectively limit opening of the one or more sashes to a predetermined opening.

Example 13 can include, or can optionally be combined with the subject matter of Examples 1-12 to optionally include wherein the one or more sashes includes a first sash and a second sash, and the at least one sash limiter assembly is coupled with the first sash, and the sash stop engages the second sash while the sash stop is in the engaging position and the second sash is opened.

Example 14 can include, or can optionally be combined with the subject matter of Examples 1-13 to optionally include wherein the at least one sash limiter assembly includes first and second sash limiter assemblies each positioned on opposed stiles of the first sash.

Example 15 can include, or can optionally be combined with the subject matter of Examples 1-14 to optionally include wherein the one or more sashes are one of vertically or horizontally slidable within the frame.

Example 16 can include, or can optionally be combined with the subject matter of Examples 1-15 to optionally include wherein the sash stop includes a sash stop ramp configured to slide relative to a sash while the sash travels over top of the sash stop in the retained position or while the sash travels toward a closed position.

Example 17 can include, or can optionally be combined with the subject matter of Examples 1-16 to optionally include a method for using a sash limiter assembly comprising: moving a sash stop from an engaging position within a translation path of a sash to a retained position out of alignment with the translation path; moving a reset to a resetting position after moving the sash stop to the retained position, moving the reset including: moving the reset within the translation path while in the resetting position, and holding the sash stop in the retained position with the reset while the reset is in the resetting position; moving the sash in a first direction (e.g., toward the fully open position) and engaging the reset in the resetting position, the reset moved from the resetting position by the engagement, movement of the reset from the resetting position releasing the sash stop; moving the sash in a second direction different from the first direction, moving the sash in the second direction moves the sash away from the sash stop; and moving the sash stop into the engaging position after release of the sash stop by the reset and moving of the sash away from the sash stop.

Example 18 can include, or can optionally be combined with the subject matter of Examples 1-17 to optionally include wherein moving the sash stop includes depressing the sash stop relative to the reset.

Example 19 can include, or can optionally be combined with the subject matter of Examples 1-18 to optionally include wherein moving the sash stop includes rotating the sash stop relative to the reset.

Example 20 can include, or can optionally be combined with the subject matter of Examples 1-19 to optionally include wherein moving the reset includes rotating the reset relative to the sash stop.

Example 21 can include, or can optionally be combined with the subject matter of Examples 1-20 to optionally include wherein moving the sash stop includes aligning a stop retaining pin with a retaining pin channel, and moving the reset includes moving the reset according to the alignment of the stop retaining pin with the retaining pin channel.

Example 22 can include, or can optionally be combined with the subject matter of Examples 1-21 to optionally include wherein holding the sash stop in the retaining position includes holding the stop retaining pin in the retaining pin channel.

Example 23 can include, or can optionally be combined with the subject matter of Examples 1-22 to optionally include arresting movement of the sash in the first direction with the sash stop in the engaging position.

Example 24 can include, or can optionally be combined with the subject matter of Examples 1-23 to optionally include wherein arresting movement includes engaging a sash stop flange of the sash stop with a housing flange of a limiter housing.

Example 25 can include, or can optionally be combined with the subject matter of Examples 1-24 to optionally include wherein arresting movement includes engaging arcuate surfaces of a limiter housing and the sash stop at a sash stop pivot in surface to surface contact.

Example 26 can include, or can optionally be combined with the subject matter of Examples 1-25 to optionally include biasing the sash stop toward the engaging position.

Example 27 can include, or can optionally be combined with the subject matter of Examples 1-26 to optionally include wherein moving the sash stop includes rotating the sash stop around a sash stop pivot, and moving the reset includes rotating the reset around a reset pivot different from the sash stop pivot.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A window assembly including a sash limiter assembly, the sash limiter assembly comprising:

a limiter housing configured for installation in one or more sashes or a window frame of a window;

a sash stop movably coupled with the limiter housing, the sash stop movable between engaging and retained positions, the sash stop includes at least one of a stop retaining pin or a retaining pin channel, the retaining pin channel having first and second ends;

a reset movably coupled with the limiter housing, the reset movable into a resetting position, the reset includes the other of the retaining pin channel or the stop retaining pin; and wherein the sash limiter assembly is configured for positioning between a sash limiting configuration and a resetting configuration, and the stop retaining pin slides between the first and second ends of the retaining pin channel in positioning between the sash limiting and resetting configurations:

in the sash limiting configuration the sash stop is in the engaging position and configured for positioning in a translation path of the sash, and in the resetting configuration the sash stop is held in the retained position by the reset held in the resetting position, and the reset is held in the resetting position by the stop retaining pin engaged along a portion of the retaining pin channel, in the retained position the sash stop is configured for positioning out of alignment with the translation path, and in the resetting position the reset is configured for positioning within the translation path.

2. The window assembly of claim 1, wherein the limiter housing includes a limiter cavity, and the sash stop is received within the limiter cavity in the retained position.

3. The window assembly of claim 1 comprising a biasing element coupled between the sash stop and the limiter housing, the sash stop is biased toward the engaging position by the biasing element.

4. The window assembly of claim 3, wherein the biasing element includes one or more of a compression spring or a torsion spring.

5. The window assembly of claim 1, wherein the limiter housing includes a housing flange, and the sash stop includes a sash stop flange, and the sash stop flange engages with the housing flange while a sash is engaged with the sash stop, and the engagement of the sash stop flange and the housing flange prevents movement of the sash past the sash stop.

6. The window assembly of claim 1, wherein one or more of the sash stop and the reset are rotatable relative to the limiter housing.

7. The window assembly of claim 6, wherein the sash stop is rotatable at a sash stop pivot, and the reset is rotatable at a reset pivot, and the reset pivot is positioned between the sash stop pivot and a sash intercepting face.

8. The window assembly of claim 1, wherein in transition from the engaging position to the retained position, the stop retaining pin is aligned with the retaining pin channel according to movement of the sash stop, and the reset is movable into the resetting position after the stop retaining pin is aligned with the retaining pin channel.

9. The window assembly of claim 1, wherein in the resetting configuration the stop retaining pin is received within the retaining pin channel, and reception of the stop retaining pin holds the sash stop in the retained position.

10. The window assembly of claim 1, wherein in the sash limiting configuration the stop retaining pin is outside of the retaining pin channel and the sash stop is released to the engaging position.

11. The window assembly of claim 1 further including:

the window frame, and the one or more sashes slidably positioned within the frame, and wherein at least one sash limiter assembly is coupled to the one or more sashes, and the at least one sash limiter assembly is configured to selectively limit opening of the one or more sashes to a predetermined opening.

12. The window assembly of claim 11, wherein the one or more sashes includes a first sash and a second sash, and the at least one sash limiter assembly is coupled with the first sash, and the sash stop engages the second sash while the sash stop is in the engaging position and the second sash is opened.

13. The window assembly of claim 12, wherein the at least one sash limiter assembly includes first and second sash limiter assemblies each positioned on opposed stiles of the first sash.

14. The window assembly of claim 11, wherein the one or more sashes are one of vertically or horizontally slidable within the frame.

15. The window assembly of claim 1, wherein the sash stop includes a sash stop ramp configured to slide relative to a sash while the sash travels over top of the sash stop in the retained position or while the sash travels toward a closed position.

16. A method for using the sash limiter assembly of claim 1 comprising:

moving the sash stop from the engaging position within the translation path of the sash to the retained position out of alignment with the translation path, moving the sash stop aligns the stop retaining pin with the retaining pin channel having first and second ends;

moving the reset to the resetting position after moving the sash stop to the retained position, moving the reset including:

moving the aligned stop retaining pin relative to the retaining pin channel between the first and second ends, moving the reset within the translation path while in the resetting position, and holding the sash stop in the retained position with the reset in the resetting position through engagement of the stop retaining pin along a portion of the retaining pin channel;

moving the sash in a first direction and engaging the reset in the resetting position, the reset moved from the resetting position by the engagement, movement of the reset from the resetting position releasing the sash stop;

moving the sash in a second direction different from the first direction, moving the sash in the second direction moves the sash away from the sash stop; and moving the sash stop into the engaging position after release of the sash stop by the reset and moving of the sash away from the sash stop.

17. The method of claim 16, wherein moving the sash stop includes depressing the sash stop relative to the reset.

18. The method of claim 16, wherein moving the sash stop includes rotating the sash stop relative to the reset.

19. The method of claim 16, wherein moving the reset includes rotating the reset relative to the sash stop.

20. The method of claim 16, wherein holding the sash stop in the retaining position includes holding the stop retaining pin in the retaining pin channel.

21. The method of claim 16 comprising arresting movement of the sash in the first direction with the sash stop in the engaging position.

22. The method of claim 21, wherein arresting movement includes engaging a sash stop flange of the sash stop with a housing flange of the limiter housing.

23. The method of claim 21, wherein arresting movement includes engaging arcuate surfaces of the limiter housing and the sash stop at a sash stop pivot in surface to surface contact.

24. The method of claim 16 comprising biasing the sash stop toward the engaging position.

25. The method of claim 16, wherein moving the sash stop includes rotating the sash stop around a sash stop pivot, and moving the reset includes rotating the reset around a reset pivot different from the sash stop pivot.

26. A window assembly including a sash limiter assembly, the sash limiter assembly comprising:

a limiter housing configured for installation in one or more sashes or a window frame of a window;

a sash stop movably coupled with the limiter housing, the sash stop movable between engaging and retained positions;

a reset movably coupled with the limiter housing, the reset movable into a resetting position;

wherein the sash stop includes at least one of a stop retaining pin or a retaining pin channel, and the reset includes the other of the retaining pin channel or the stop retaining pin, the retaining pin channel having first and second ends; and wherein the sash limiter assembly is configured for positioning between a sash limiting configuration and a resetting configuration:

in the sash limiting configuration the sash stop is in the engaging position and configured for positioning in a translation path of the sash, and in the resetting configuration the sash stop is held in the retained position by the reset in the resetting position, the reset retains the sash stop in the retained position through sliding reception of the stop retaining pin between the first and second ends of the retaining pin channel, in the retained position the sash stop is configured for positioning out of alignment with the translation path, and in the resetting position the reset is configured for positioning within the translation path.

27. The window assembly of claim 26, wherein the sash stop is directly coupled with the limiter housing at a stop pivot, and the reset is directly coupled with the limiter housing at a reset pivot different from the stop pivot.

* * * * *